US005911540A

United States Patent [19]

Adamson

[11] Patent Number: 5,911,540

[45] Date of Patent: Jun. 15, 1999

[54] SUBTERRANEAN LIQUID DISTRIBUTION APPARATUS

[76] Inventor: Karl Adamson, 10295 Robin Ave., Grass Valley, Calif. 95945

[21] Appl. No.: 08/996,791

[22] Filed: Dec. 23, 1997

[51] Int. Cl.[6] ..... E02B 11/00

[52] U.S. Cl. ..... 405/43; 405/45; 52/169.1; 52/169.5

[58] Field of Search ..... 405/43, 45; 52/169.14, 52/169.5, 302.1, 592.6, 169.1

[56] References Cited

U.S. PATENT DOCUMENTS

| | | | |
|---|---|---|---|
| 3,563,038 | 2/1971 | Healy et al. | 405/45 |
| 4,304,080 | 12/1981 | Freeman | 52/592.6 X |
| 4,333,281 | 6/1982 | Scarfone . | |
| 4,730,953 | 3/1988 | Tarko | 52/169.5 X |
| 4,904,113 | 2/1990 | Goddard et al. | 405/45 |
| 5,133,163 | 7/1992 | Christensen et al. . | |
| 5,289,664 | 3/1994 | Rizza et al. . | |
| 5,383,314 | 1/1995 | Rothberg | 405/45 X |
| 5,489,462 | 2/1996 | Sieber | 405/45 X |
| 5,542,223 | 8/1996 | Inda et al. | 52/302.1 |
| 5,615,525 | 4/1997 | Kenworthy . | |
| 5,765,970 | 6/1998 | Fox | 52/592.6 X |
| 5,795,100 | 8/1998 | Thomas et al. | 405/45 |

*Primary Examiner*—Tamara Graysay
*Assistant Examiner*—Jong-Suk Lee
*Attorney, Agent, or Firm*—Theodore J. Bielen, Jr.

[57] ABSTRACT

The subterranean liquid distribution or liquid routing apparatus utilizing a housing having a wall portion forming an inner chamber. The housing includes inner and outer surfaces, the former defining the inner chamber of the housing. A plurality of apertures in the wall portion of the housing permit communication with the inner chamber and allow liquids to pass either into or out of the inner chamber. At least a pair of protuberances extend from the inner surface of the wall portion of the housing in contact one another to prevent collapsing of the housing chamber. An opening is also found to the housing chamber in spaced relationship to the plurality of apertures which generally serves as the drainage or source of the liquid being distributed by the apparatus.

8 Claims, 3 Drawing Sheets

SUBTERRANEAN LIQUID DISTRIBUTION APPARATUS

BACKGROUND OF THE INVENTION

The present invention relates to a novel and useful subterranean liquid distribution apparatus.

Subterranean or percolated liquid, such as water, must be controlled on and below ground surfaces in order to avoid problems of erosion, or to effect septic treatment or irrigation. In the past, culverts, pipes, ditches, and like structures have been employed. Of particular note are perforated pipes which are generally placed below from the ground surface in order to collect subterranean water and other liquids. Although successful in most cases, such drainage systems often only collect a portion of the liquids and are quite expensive to install, especially in conjunction with a structure such as a building, wall, fence, and the like.

Prior liquid routing systems have been proposed is such as found in U.S. Pat. No. 4,333,281, which describes a basement wall draining molding having a perforated pipe that is partially surrounded by drain rock and which communicates with the interior of a concrete wall in which moisture has accumulated.

U.S. Pat. Nos 5,133,163 and 5,289,664 show conduit drains which are encased in concrete and accept water from a building or garden.

U.S. Pat. No. 5,615,525 describes a thermal plastic foam insulation panel which includes channels to guide water from the exterior wall of the building to a perforated pipe below grade.

A subterranean liquid distribution apparatus of a modular nature which is extremely efficient in collecting water of all levels below grade would be a notable advance in the construction arts.

SUMMARY OF THE INVENTION

In accordance with the present invention a novel and useful subterranean liquid distribution system is herein provided.

The system of the present invention employs an apparatus which includes a housing having a wall portion that forms an inner chamber. The housing may be of any three-dimensional shape, such as a cube, a rectangular solid, a disc, and the like. The wall portion of the housing includes a first inner surface within the chamber of the housing and a second outer surface on the outside of the housing. Such housing may be constructed of any material and is particularly suited to plastic materials, which may be injection molded. The housing may also be formed in two sections and fastened together to eventually form the finished housing unit.

A plurality of apertures are formed in the wall portion of the housing to permit communication with the inner chamber. Thus, the liquid exterior to the housing may flow into the inner chamber through the plurality of apertures. Such apertures may be in the form of slots that are formed by a series of intrusions to the inner chamber with the end portion removed therefrom. The slots, or apertures, may be found at multiple levels along the outer surface of the housing to permit liquid to enter the inner chamber of the housing at these multiple levels along the housing.

At least a pair of protuberances are also formed to extend from the first inner surface of the wall portion of the housing. The protuberances may be shaped as truncated cones and are intended to contact one another to prevent collapsing of the housing chamber by inward movement of the housing walls. The protuberances, where the housing is formed in two pieces, may be molded into both sections forming the eventual finished housing structure.

The base or bottom of the housing may also be provided with an opening, which is roughly in the shape of a conduit. Such conduit may serve as the drain for the inner chamber of the housing or also serve as the entry point for liquid flowing into the housing inner chamber for distribution and direction through the plurality of openings. Of course, such directional flow is dependent on the eventual use of the apparatus of the present invention.

The apparatus housing may also be formed with a first edge portion having a lip and a second edge portion having a friction surface. With identical housing units being placed adjacent one another in a horizontal configuration, the lip is intended to frictionally engage the friction surface of an adjacent housing unit such that pair of housing units snap together to form a liquid distribution apparatus including multiple housings. Of course, such multiple housings, formed in this manner, create a line of housing units which may be placed in a subterranean trench. also, the openings to the housing, spaced from the plurality of apertures, also interconnect in a horizontal direction to form a single drain line or entry line for the distribution of liquids.

In addition, housing units of the present invention may be formed with third portions having a flange and fourth edge portions having a recess. The third and fourth edge portions would permit stacking of the housing units in a vertical direction for use in trenches that are deeper than ones using a single row of housing units which have been connected to lie in a horizontal direction.

It may be apparent that a novel and useful subterranean liquid distribution apparatus has been described.

It is therefore an object of the present invention to provide a subterranean liquid distribution apparatus that is extremely efficient in delivering or draining liquid below grade or at various levels below the ground surface.

Another object of the present invention is to provide a subterranean liquid distribution apparatus using a modular housing which is capable of either being nested together in horizontal direction or being stacked in a vertical direction, to provide drainage or distribution of liquid over a large area.

Another object of the present invention is to provide a subterranean liquid distribution apparatus which is simple to manufacture and assemble.

A further object of the present invention is to provide a subterranean liquid distribution apparatus which is simple and inexpensive to install when compared to the drainage and distribution systems of the prior art.

It is another object of the present invention to provide a subterranean liquid distribution apparatus which serves the dual purpose of either draining water from a subterranean area or to deliver liquid to a subterranean area for the purpose of waste treatment, irrigation, or the like.

The invention possesses other objects and advantages especially as concerns particular characteristics and features thereof which will become apparent as the specification continues.

For a better understanding of the invention reference is made to the following detailed description of the preferred embodiments thereof which should be compared to the prior described drawings.

DETAILED DESCRIPTION OF THE PREFERRED EMBODIMENTS

Various aspects of the present invention will evolve from the following detailed description of the preferred embodiments thereof which should be taken in conjunction with the hereinbefore described drawings.

Figure 2:
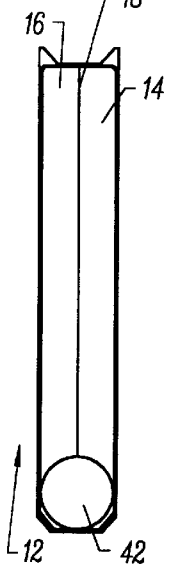
FIG. 2 is a end view of the apparatus of the present invention as depicted in FIG. 1.
Figure 4:
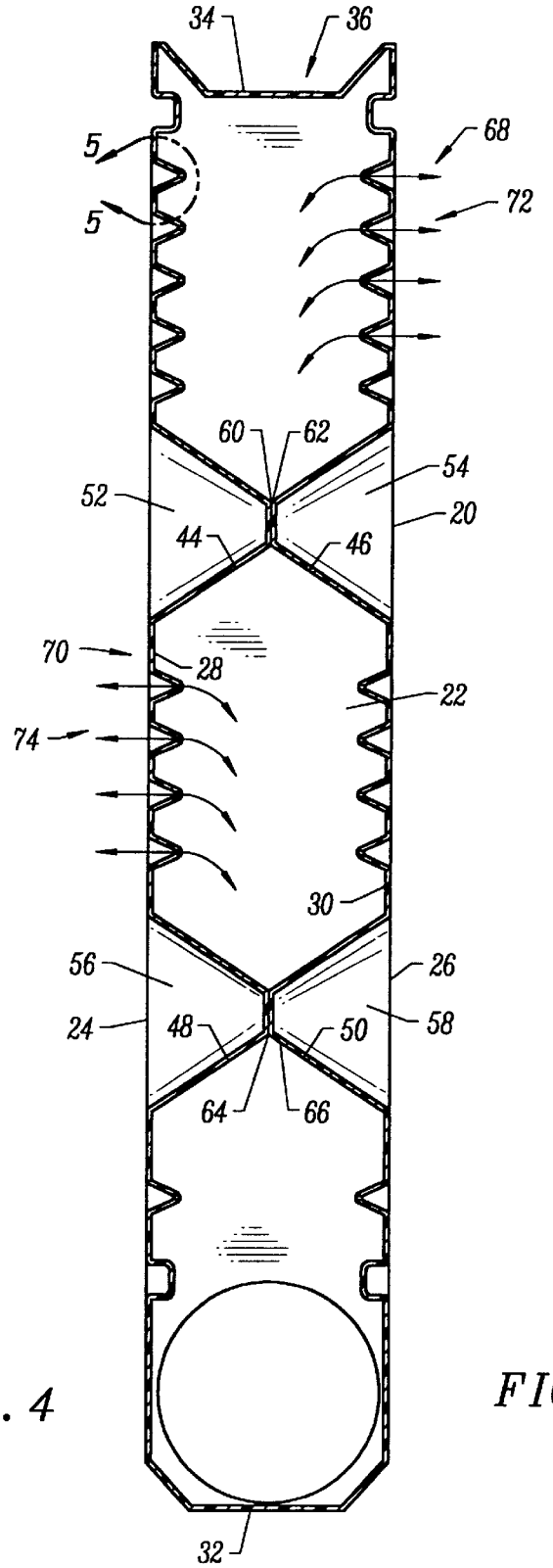
FIG. 4 is a sectional view taken along line 4—4 of FIG. 1.
Figure 7:
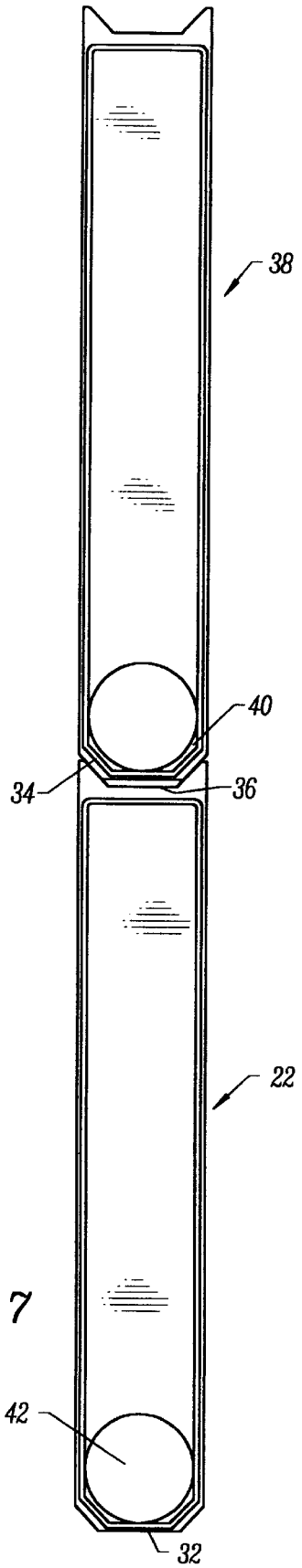
FIG. 7 is an end view depicting the vertical stacking capabilities of the apparatus of the present invention.

The invention as a whole is depicted in the drawings by reference character 10. The subterranean liquid distribution apparatus 10 includes as one of its elements a housing 12. Housing 12 may be formed of any suitable material such as plastic, metal, and the like. For example, housing 12 may be formed of polymeric materials, such as polyethylene, polypropylene, polystyrene. In many cases, housing 12 may be vacuum formed, injection molded, and the like, into halves 14 and 16 and then connected into one unit by sonic welding, or otherwise, along a seam 18, FIG. 2. Housing 12 in the present embodiment generally takes a rectangular solid shape and includes a wall portion 20 forming an inner chamber 22. Housing 12 may assume other shapes. Outer surfaces 24 and 26 lie opposite inner surfaces 28 and 30 within chamber 22 best shown in FIG. 4. Lower edge portion 32 of wall portion 20 of housing 12 is generally three sided. Upper edge portion 34 is also three sided, but includes a recess 36 to accept edge portion such as an edge portion 32 from like structures to housing 12. For example, housing 38 is depicted as being stacked atop housing 22 such that edge portion 40 of housing 38, substantially similar to edge portion 32 of housing 22, fits within recess 36 of edge portion 34. Opening 42 leads to chamber 22 to permit liquid to enter or egress chamber 22, which will be detailed hereinafter as the specification continues.

Protuberances 44, 46, 48, and 50 extend into inner chamber 22. Cavities 52, 54, 56, and 58 lie inwardly from the normal contour of outer surfaces 24 and 26. Specifically, protuberances 44, 46, 48, and 50 are associated with cavities 52, 54, 56, and 58, respectively. It should also be apparent, that protuberances 44 and 46 contact each other at end surfaces 60 and 62. Likewise, protuberances 48 and 50 contact each other at end surfaces 64 and 66 within chamber 22. Such contact prevents the inward movement or collapse of chamber 22 of housing 12.

Figure 5:
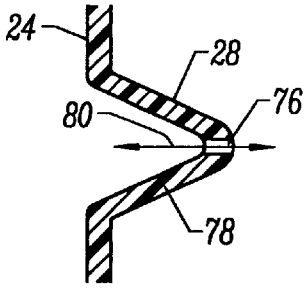
FIG. 5 is a sectional view showing the structure of a single aperture slot along line 5—5 of FIG. 4.
Figure 5A:
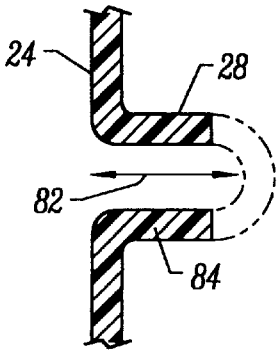
FIG. 5A is an alternate embodiment of the aperture slot depicted in FIG. 5.

A plurality of apertures 68 on surface 26 and a plurality of apertures 70 on surface 24 of wall portion 20 permit the entrance or egress of liquids such as water relative to chamber 22. Plurality of apertures 68 and 70 take the form of slots extending generally across surfaces 24 and 26. Directional arrows 72 and 74 depict the direction of movement of liquid relative to chamber 22, FIG. 4. With reference to FIGS. 5 and 5A, it may be observed that a typical aperture or slot 76 is depicted. It may be seen that slot 76 is cut from an inwardly extending ridge 78. Again, bi-directional arrow 80 depicts the possible movement of liquid through slot 76. FIG. 5A shows another embodiment of any of the plurality of apertures 68 and 70. Orthogonal ridge 84 is cut-off at the extreme inwardly extending area of ridge 84 to form aperture 82.

Figure 1:
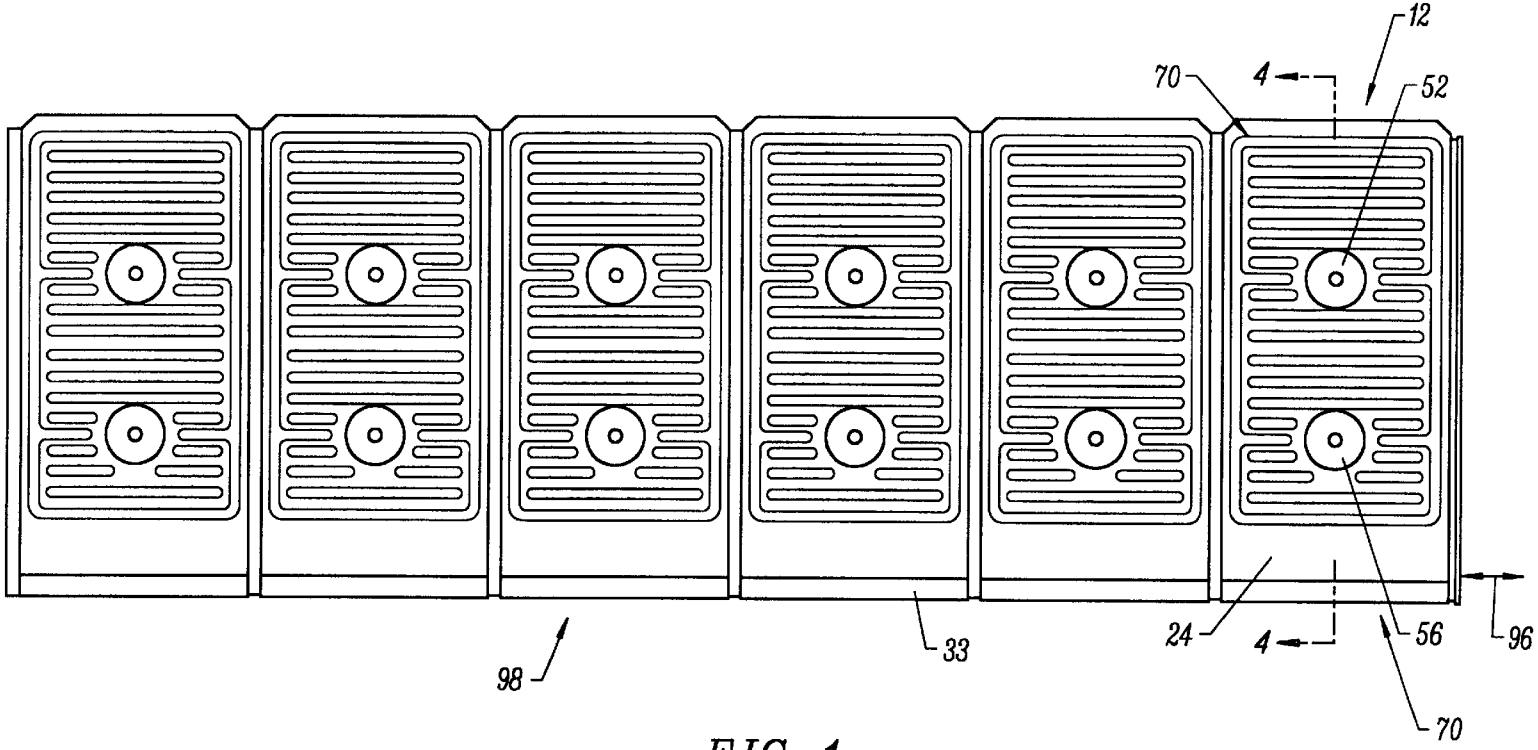
FIG. 1 is a side elevational view showing a horizontal line of apparatuses of the present invention.
Figure 6:
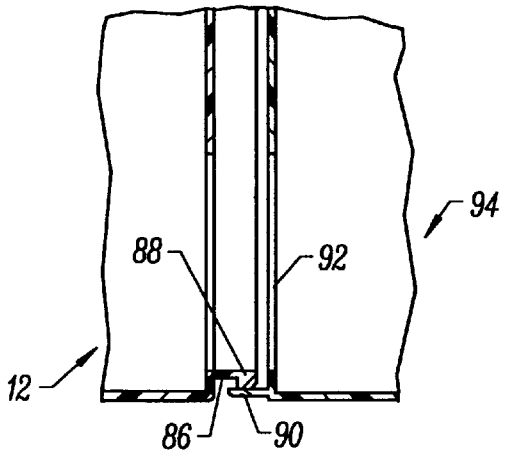
FIG. 6 is a sectional view taken along line 6—6 of FIG. 3.

Turning to FIG. 6, it may be observed that each housing, such as housing 12, includes an edge portion 86 with a lip 88. A friction flange 90 also appears on each housing such, as housing 12, that is shown in FIG. 6 as a part of edge portion 92 of housing 94. Thus, lip 88 and friction flange 90 of adjacent housing 94 permit the same to snap together in a horizontal direction. In such case, liquid openings in adjacent housings, such as opening 42 of housing 12 form an internal conduit 33, FIG. 1. Directional arrow 96 shows the direction of flow of liquid in or out of plurality of housings 98 which have been snapped together, through conduit 33, below grade or below ground surface 100.

Figure 3:
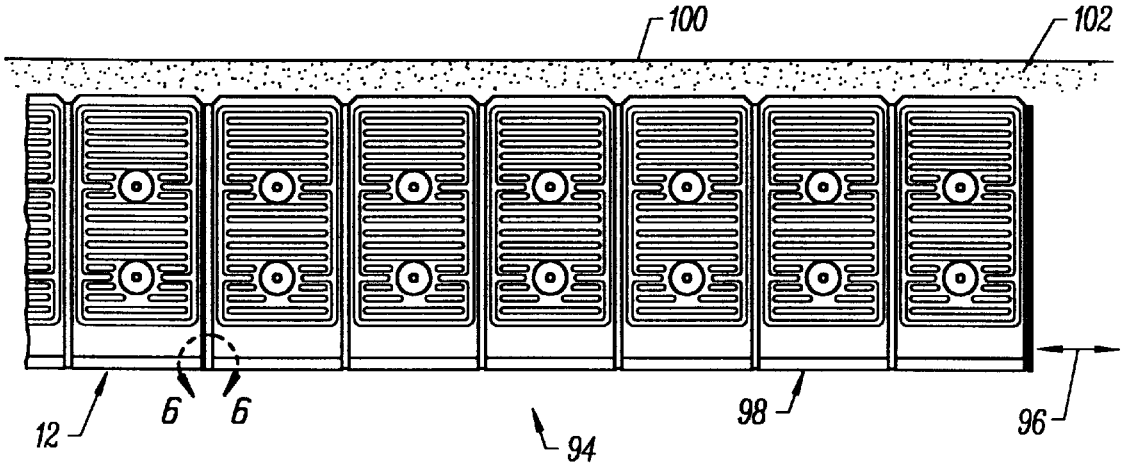
FIG. 3 is a side elevational view of multiple apparatuses of the present invention nested a horizontal manner below grade.

In operation, identical apparatuses, such as apparatus 10, are placed below ground surface 100 after digging a shallow trench. Such trenching requires a trenching tool which is cheaper to operate than the usual backhoe, required in the prior art. Plurality of housings or apparatuses 98, FIG. 3, are then snapped together in a horizontal direction utilizing the lip 88 and friction flange 90 depicted as typical of the edge portions 86 and 92 of a housing such as housing 12. The openings, such as opening 42 of each apparatus depicted in FIG. 3, align to form internal conduit 33 to permit liquid, such as water, to travel into or out of each apparatus. For example, with respect to apparatus 10 having inner chamber 22 water may drain from soil 102 below ground surface 100 and pass through plurality of apertures 68 and 70 into inner chamber 20 and outwardly from housing 12 via opening 42, which is spaced from plurality of apertures 68 and 70. On the other hand, liquid such as water, it may be passed to opening 42 when apparatus 10 is employed in a septic or irrigation manner. Liquid then passes up through chamber 22 and outwardly from plurality of apertures 68 and 70. Thus, apparatus 10 possesses great versatility in its use and its modular nature permits the stacking or lateral nesting of the same to serve as a large area beneath ground surface 100.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A subterranean liquid distribution apparatus, comprising:

a. a first housing having a wall portion forming an inner chamber, said wall portion including a first inner surface within said inner chamber and a second outer surface on the outer side of said first housing, said first housing further including a first edge portion having a lip, and a second edge portion having a friction surface;

b. a plurality of apertures in the wall portion of said first housing to permit communication with said inner chamber;

c. a pair of protuberances extending from said first inner surface of said wall portion of said first housing, said pair of protuberances contacting each other to prevent collapsing of said inner chamber;

d. an opening to said inner chamber of said first housing spaced from said plurality of apertures; and e. an internal conduit located within said first housing below said apertures, said internal conduit communicating with said opening, gathering liquid flowing downwardly from said plurality apertures, and directing liquid to flow laterally from said first housing through said opening; said lip of said first edge portion of said first housing mating with a second edge portion having a friction surface of a second housing, similarly configured to said second edge portion of said first housing, said mating further providing communication between said opening of said first housing and an opening in said second housing communicating with an internal conduit, such that liquid flows laterally between said internal conduits of said first and second mated housings.

2. The apparatus of claim 1 in which said first housing further includes a third edge portion having a flange and a fourth edge portion having a recess.

3. The apparatus of claim 2 in which said third edge portion having said flange of said first housing nests with a fourth edge portion having a recess of a third housing, similarly configured to said fourth edge portion of said first housing.

4. The apparatus of claim 1 in which said opening to said first housing chamber is a liquid drain opening.

5. The apparatus of claim 1 in which said opening to said first housing chamber is a liquid entrance opening.

6. The apparatus of claim 1 in which said plurality of apertures in the wall portion of said first housing comprises a plurality of slots.

7. The apparatus of claim 6 in which each of said slots includes a recess extending inwardly to said inner chamber.

8. The apparatus of claim 1 in which said pair of protuberances is a first pair of protuberances and said apparatus further comprises a second pair of protuberances extending from said wall portion of said first housing to contact each other to prevent collapsing of said inner chamber.

* * * * *